US006558021B2

(12) United States Patent
Wu et al.

(10) Patent No.: US 6,558,021 B2
(45) Date of Patent: May 6, 2003

(54) LIGHT EMITTING DIODE MODULES FOR ILLUMINATED SIGNS

(75) Inventors: Chen H. Wu, Los Altos Hills, CA (US); Han-Jen Chuang, Kee-Lung (TW)

(73) Assignee: Leotek Electronics Corporation, Taipei Hsien (TW)

( * ) Notice: Subject to any disclaimer, the term of this patent is extended or adjusted under 35 U.S.C. 154(b) by 0 days.

(21) Appl. No.: 09/927,144

(22) Filed: Aug. 10, 2001

(65) Prior Publication Data

US 2003/0031032 A1 Feb. 13, 2003

(51) Int. Cl.[7] ..... G09F 13/00

(52) U.S. Cl. ..... 362/249; 362/800; 362/812; 362/545; 340/815.45; 340/815.53

(58) Field of Search ..... 362/800, 249, 362/250, 237, 812, 545, 251; 40/541, 542, 605; 340/815.45, 815.53

(56) References Cited

U.S. PATENT DOCUMENTS

| | | | | | |
|---|---|---|---|---|---|
| 5,278,432 | A | * | 1/1994 | Ignatius et al. | 257/723 |
| 5,404,282 | A | * | 4/1995 | Klinke et al. | 362/249 |
| 5,519,596 | A | * | 5/1996 | Woolverton | 362/250 |
| 5,900,850 | A | * | 5/1999 | Bailey et al. | 340/815.83 |
| 5,950,340 | A | | 9/1999 | Woo | 362/564 |
| 6,023,869 | A | | 2/2000 | Durbin | 362/544 |
| 6,024,476 | A | | 2/2000 | Wakeman | 362/581 |
| 6,027,235 | A | | 2/2000 | Chen | 362/497 |
| 6,065,854 | A | * | 5/2000 | West et al. | 211/87.01 |
| 6,175,342 | B1 | * | 1/2001 | Nicholson et al. | 345/1.1 |
| 6,244,727 | B1 | * | 6/2001 | Ryan et al. | 362/237 |
| 6,314,669 | B1 | * | 11/2001 | Tucker | 40/448 |
| 6,380,865 | B1 | * | 4/2002 | Pederson | 340/321 |

OTHER PUBLICATIONS

SloanLED, "ChanneLED LED Lighting System", website advertising, http://www.sloanled.com/prod03.htm. Mar. 31, 2000, 2 pages.

SloanLED, "LEDstripe LED Lighting System", website advertising, http://www.sloanled.com/prod02.htm. Mar. 31, 2000.

Sloan Company, Inc., "Leaders In LED Technology: LED LIGHTBOARDS", website advertising, http://www.sloancorp.com//LEDLIGHTBOARDS.htm, Jul. 18, 1992, 2 pages.

Sloan Company, Inc., "Leaders In LED Technology: Sloan Offers the BRIGHTEST LED's Available", website advertising, http://www.sloancorp.com//LED.htm, Oct. 4, 2000, 1 page.

(List continued on next page.)

*Primary Examiner*—Sandra O'Shea
*Assistant Examiner*—Hargobind S Sawhney
(74) *Attorney, Agent, or Firm*—Gray Cary Ware & Freidenrich LLP

(57) ABSTRACT

A light emitting diode module for attaching to a surface of a sign, which includes a mounting plate having top and bottom surfaces, a plurality of light emitting diodes mounted to the top surface of the mounting plate, a housing having top and bottom surfaces, a first electrical connector attached to the bottom surface of the mounting plate and electrically connected to the plurality of light emitting diodes, a second electrical connector attached to the top surface of the housing for engaging with the first electrical connector, a third electrical connector attached to the housing and electrically connected to the second electrical connector, and a power supply for providing a voltage to the third electrical connector. As the bottom surface of the mounting plate is placed on the top surface of the housing, the first electrical connector engages with the second electrical connector for electrically connecting the plurality of light emitting diodes to the third electrical connector. Alternatively, the mounting plate could be integrally formed as part of the housing, and the first and second electrical connectors omitted.

21 Claims, 5 Drawing Sheets

OTHER PUBLICATIONS

Hitech Electronic Displays, "ChannelLights", website advertising http://www.hitechled.com/ilumiletter.htm,, 2 pages.

Hitech Electronic Displays, "ILumiLETTER Channel Letter Lighting System Components", preliminary technical data sheet, 2 pages.

Permlight, "700 Series LED'R Lights", website advertising http://www.permlight.com/products/signage.html, 2 pages.

Permlight, "700 Series LED'R Lights for Channel Letters", technical data sheet, 2001, 2 pages.

Permlight, "700 Series LED'R Lights for Channel Letters", website advertising, http://www.permlight.com/literature/installation2.html, Mar. 2001, 1 page.

* cited by examiner

LIGHT EMITTING DIODE MODULES FOR ILLUMINATED SIGNS

FIELD OF THE INVENTION

The present invention relates to Light Emitting Diodes (LEDs), and more particularly to the design and use of LED modules for various illumination applications, such as commercial signs, street signs, channel letter signs, etc. The invention utilizes module designs that are flexible in mounting method, electrical connection method, LED array arrangements and optical designs.

BACKGROUND OF THE INVENTION

Light Emitting Diodes (LEDs) have been used in many applications to replace conventional incandescent lamp, fluorescent lamp, neon tube and fiber optic light sources in order to reduce electrical and maintenance costs and to increase reliability and lifetime. One such application is channel letter signs, which are signs having sidewalls and a front translucent face formed in the shape of a letter, number or other insignia. Conventional light sources, such as neon tubes, have been used to illuminate the front translucent face of such signs. Neon tubes are ideal for channel letter signs because they can be shaped to fit into narrow, shaped channels. However, neon tubes consume significant energy and require high voltage to operate. Further, neon tubes do not function well in low temperatures. Fiber optics have been used as the light source (see U.S. Pat. No. 6,024,476 by Wakeman). However, even though the use of fiber optic sources provides more flexibility, this solution is still energy consuming and exhibits a limited life time.

Due to the fact that LEDs consume less electrical energy than conventional light sources while exhibiting much longer lifetime, many designs are now being developed specifically for applications such as channel letter signs utilizing LEDs. For example, PermLight of Tustin, Calif. markets an LED based light for channel letter signs, wherein the light attaches to the side wall of the sign. The output light is directed toward the bottom wall, which scatters the light to illuminate the interior of the sign, including the front translucent surface. There are several major disadvantages of this design. The reflectivity of the bottom surface of the channel letter sign can decrease with time due to surface degradation. Further, when the channel is wide, the illumination from the LED based lamp may not be very even or the light intensity may not be enough because of the large surface area that it needs to cover. Moreover, illumination efficiency is rather low because the front surface of the sign is not directly illuminated, but rather is illuminated after the light undergoes reflections off of the interior surfaces of the sign bottom walls.

SloanLED of Ventura, Calif. markets LED strips that can be disposed in channel letter signs. However, the LED strips are hard or impossible to install around the curved portions of the channel letter, and illumination can be very uneven, especially when the depth of the channel letter is shallow or varies.

Hi-Tech Electronic Displays of Clearwater, Fla. offers a flexible metal clip with LEDs for channel letter sign applications. The major disadvantages of this design are that its installation and electrical connections are rather complicated (requiring a special insertion tool to add LEDs), and it is unclear how to move installed LEDs if illumination is insufficiently uniform.

Other types of illuminated signs include commercial and street signs, where LED arrays are used to illuminate the sign plate from the sides of the plate, as shown in Chen (U.S. Pat. No. 6,027,235), Durbin (U.S. Pat. No. 6,023,869) and Woo (U.S. Pat. No. 5,950,340). Often times, due to the poor coupling of the light to the plate and the limitation on the.number of LEDs that can be installed on the sides, light intensity may not be sufficient for many applications.

The objective of the present invention is to provide an LED module design that can be easily installed in all applications and is flexible in the method of electrical connection and arrangement of the LED's. Such LED module designs should be usable in channel letter and commercial signs of any size and with basically any light intensity requirements.

SUMMARY OF THE INVENTION

The present invention solves the aforementioned problems by providing LED modules that can be easily located throughout the interior of translucent signs for even illumination thereof.

The light emitting diode module of the present invention attaches to a surface of a sign, and includes a housing, a plurality of light emitting diodes mounted to a top surface of the housing, a plurality of first electrical connectors attached to side surfaces of the housing and electrically connected to the plurality of light emitting diodes, means for attaching a bottom surface of the housing to a surface of a sign, and a power supply for providing a voltage to the light emitting diodes via at least one of the first electrical connectors.

In another aspect of the present invention, the light emitting diode module includes a mounting plate having top and bottom surfaces, a plurality of light emitting diodes mounted to the top surface of the mounting plate, a housing having top and bottom surfaces, a first electrical connector attached to the bottom surface of the mounting plate and electrically connected to the plurality of light emitting diodes, a second electrical connector attached to the top surface of the housing for engaging with the first electrical connector, a third electrical connector attached to the housing and electrically connected to the second electrical connector, and a power supply for providing a voltage to the third electrical connector, wherein, as the bottom surface of the mounting plate is placed on the top surface of the housing, the first electrical connector engages with the second electrical connector for electrically connecting the plurality of light emitting diodes to the third electrical connector.

In yet another aspect of the present invention, an illuminated sign includes a back wall, a translucent front face that opposes the-back wall, a sidewall that is attached between the back wall and the front face, a power supply and a plurality of LED modules. Each LED module includes a housing having top and bottom surfaces, a plurality of light emitting diodes mounted to the top surface of the housing, and a first electrical connector attached to the housing and electrically connected to the plurality of light emitting diodes. The power supply provides a voltage to the first electrical connectors. For each of the LED modules, the bottom surface of the housing is attached to the back wall so that the plurality of light emitting diodes faces the front face.

In yet one more aspect of the present invention, the illuminated sign includes a back wall, a translucent front face that opposes the back wall, a sidewall that is attached between the back wall and the front face, a power supply, and a plurality of LED modules. Each LED module includes a mounting plate having top and bottom surfaces, a plurality of light emitting diodes mounted to the top surface of the mounting plate, a housing having top and bottom surfaces, a first electrical connector attached to the bottom surface of the mounting plate and electrically connected to the plurality of light emitting diodes, a second electrical connector attached to the top surface of the housing for engaging with the first electrical connector, and a third electrical connector attached to the housing and electrically connected to the second electrical connector. As the bottom surface of the mounting plate is placed on the top surface of the housing, the first electrical connector engages with the second electrical connector for electrically connecting the plurality of light emitting diodes to the third electrical connector. The power supply provides a voltage to the third electrical connectors. For each of the LED modules, the bottom surface of the housing is attached to the back wall so that the plurality of light emitting diodes faces the front face.

Other objects and features of the present invention will become apparent by a review of the specification, claims and appended figures.

DETAILED DESCRIPTION OF THE PREFERRED EMBODIMENTS

Figure 1A:
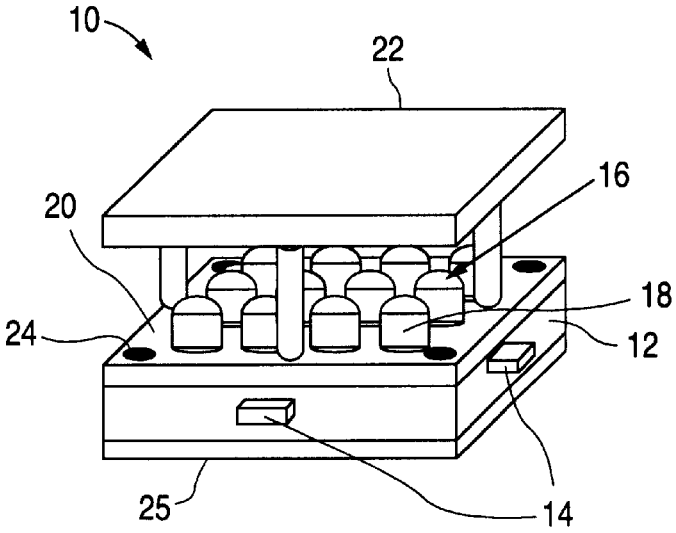
FIG. 1A is a side perspective view of the LED module of the present invention.
Figure 1B:
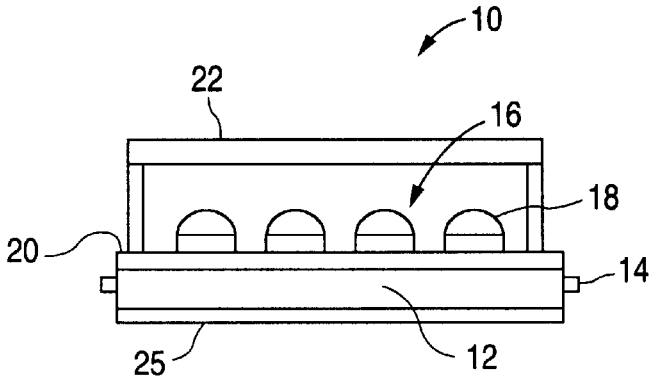
FIG. 1B is a side cross sectional view of the LED module of the present invention.

The present invention is an LED module 10 that includes a module housing 12, electrical connectors 14 attached to the housing 12, and an LED assembly 16 attached to the housing 12, as illustrated in FIGS. 1A and 1B.

LED assembly 16 includes a plurality of light emitting diodes (LEDs) 18 mounted to a top surface 20 of the housing 12, and preferably an optical lens 22 attached to either the housing 12 or LED assembly 16. The electrical leads from each LED 18 extend through the top surface 20 and are electrically connected to the electrical connectors 14. Attachment holes 24 are formed in the housing for attaching the housing 12 with screws (not shown) to the bottom wall of a sign. Lens 22 re-directs the light output from the LEDs 18 to produce a desired distribution of the light output. An adhesive 25, such as double stick tape or glue, can also be used alone or with the screws to mount the LED module 10 in place.

Both the housing 12 and the LED assembly 16 can be of any shape and size, depending on the application. The LED assembly 16 preferably includes the optical lens 22, depending on application. For example, a small channel letter sign will most likely need smaller LED assemblies 16 (fewer LEDs 18) with lenses 22 that significantly spread the light output. For larger commercial signs, larger LED assemblies 16 (more LEDs 18) are most likely appropriate, with either no lenses or lenses 22 that only moderately spread the light output.

Figure 2:
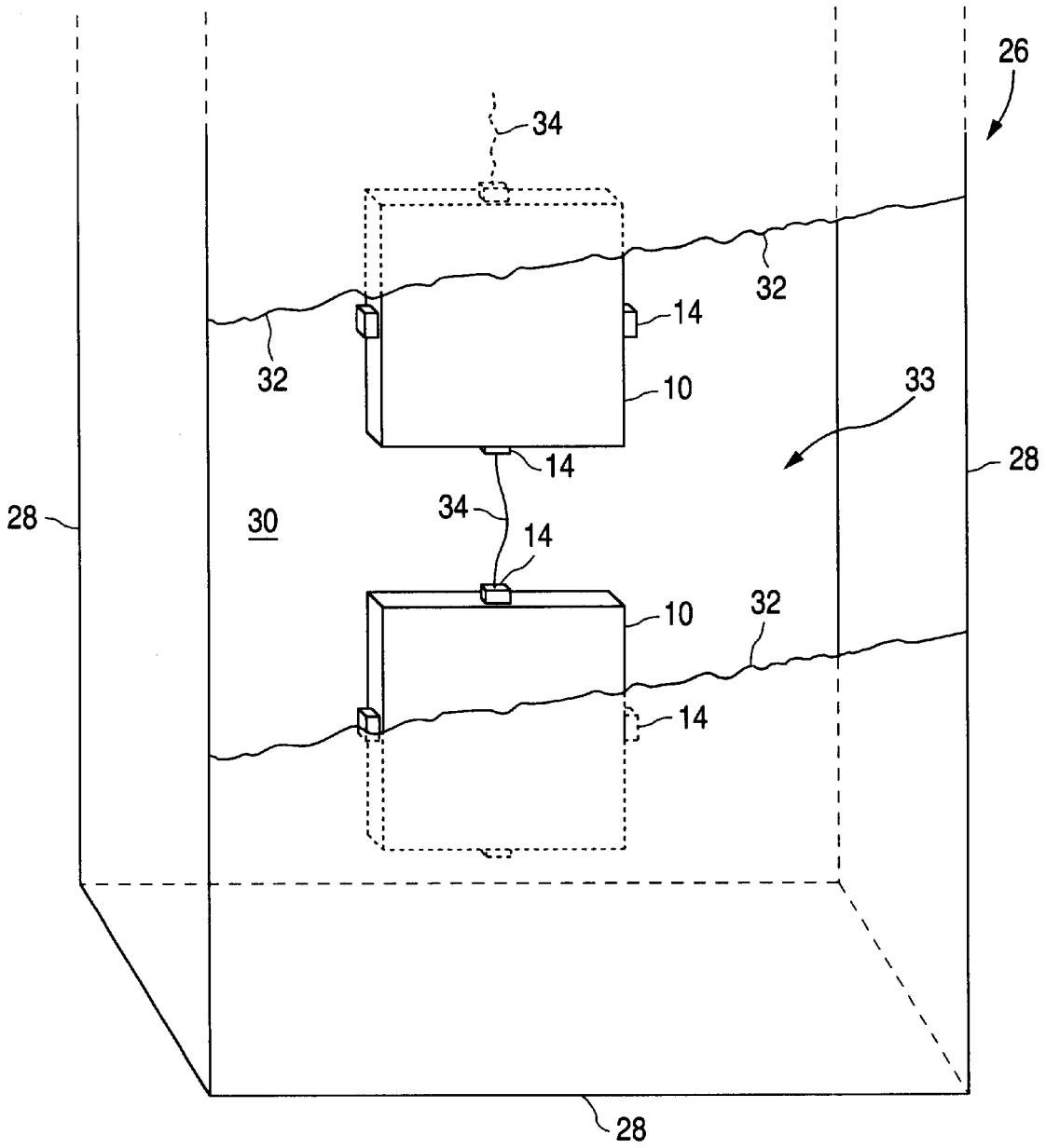
FIG. 2 is a partially broken away perspective view of the channel sign of the present invention.

FIG. 2 illustrates a channel letter sign 26. The sign has side walls 28, a back wall 30, and a translucent front face 32, which together form channel(s) 33 therebetween in the shape of a letter, number, design, etc. Translucent front face 32 passes light through part or all of its surface area. LED modules 10 are attached to the back wall 30 so the LEDs 18 face the front face 32. Once the LED modules 10 are placed in the desired locations for even illumination of front face 32, connector wires 34 are used to electrically connect the LED modules 10 together via the electrical connectors 14, and to an external power supply 36 (which can be located either inside or outside channel of letter sign 26). Connectors 14 and electrical wires 34 can be of any conventional type and size, and will vary depending on the power consumption requirements. Since all LEDs 18 require low voltage to drive, the power supply 36 can be designed for optimization of power consumption depending upon the number of modules 10 needed in the sign. The power supply 36 may be designed to generate power below 44 volts to meet UL certification. All driven voltages can be AC, DC, half or full wave.

Figure 3A:
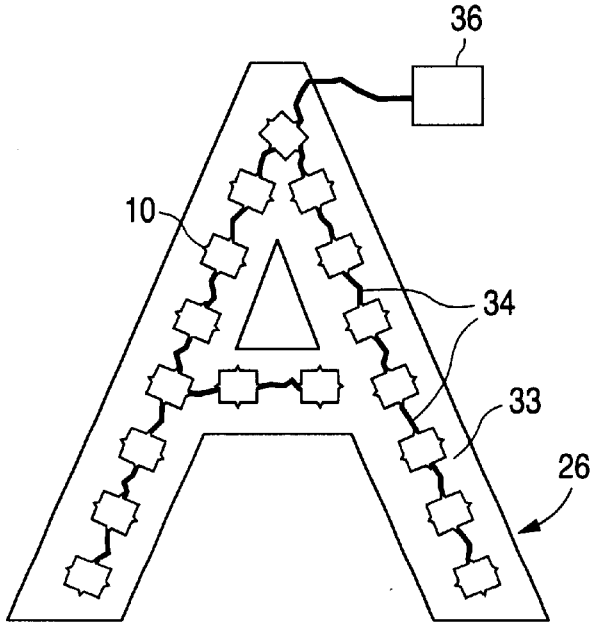
FIGS. 3A to 3C are front views of the channel signs of the present invention, with either a clear or removed translucent front face.
Figure 3B:
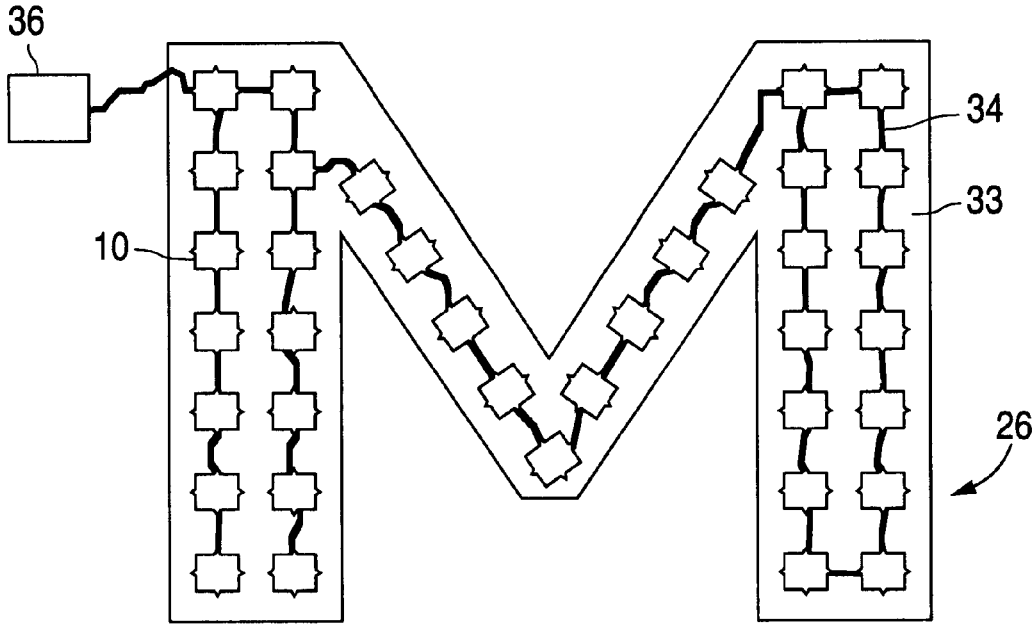
Figure 3C:
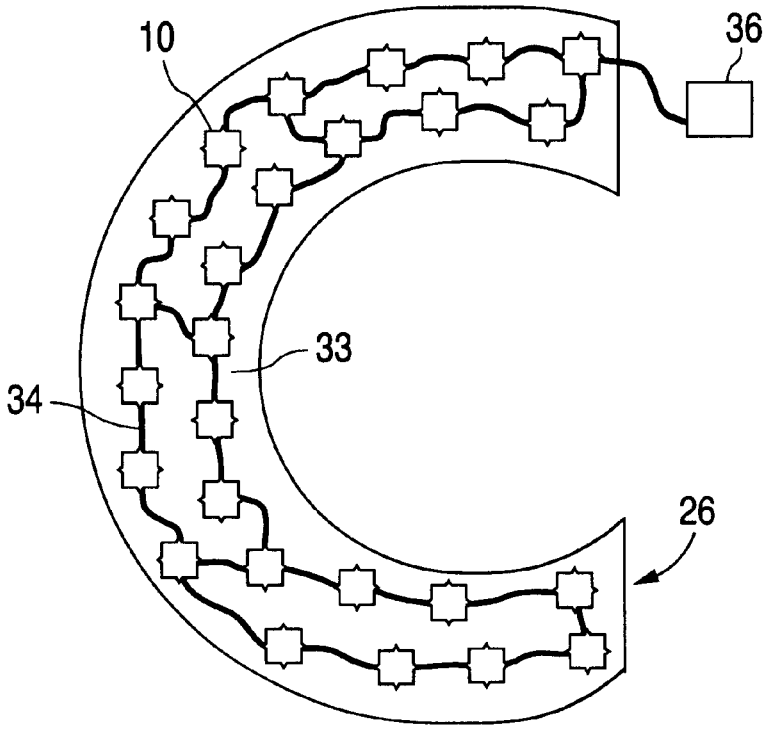
Figure 3D:
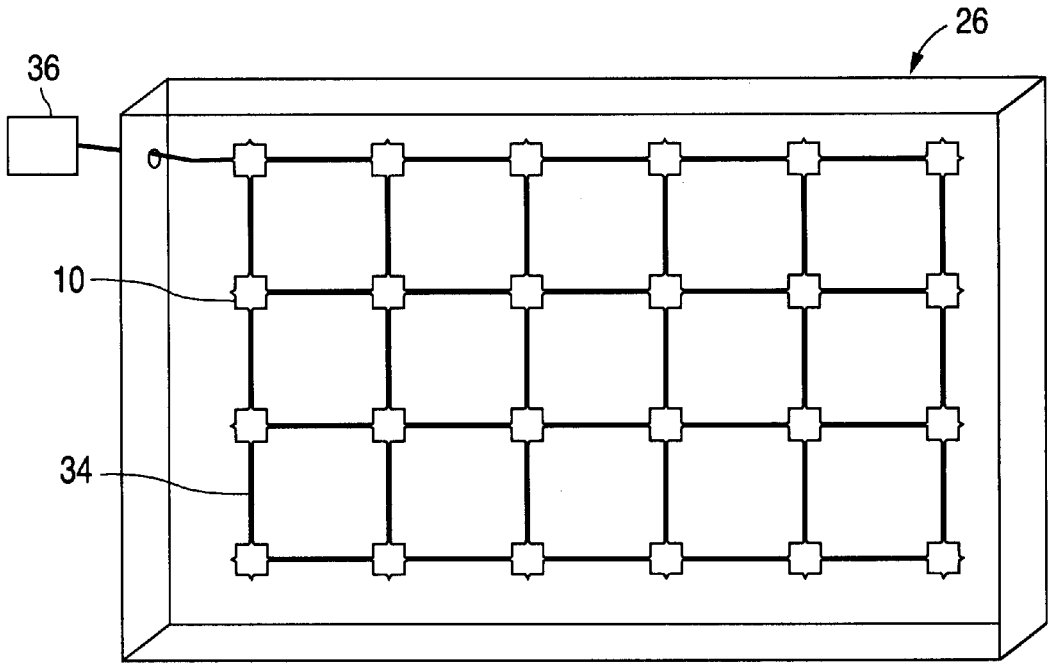
FIG. 3D is a perspective view of the LED module used in an illuminated sign box.

FIGS. 3A to 3C illustrate the versatility of the present invention, where the sign's front face is either clear or removed so the sign's interior is visible. The electrical connection between the LED modules 10 can be easily achieved using the connector wires 34 before or after the modules 10 are optimally placed inside the channel letter sign 26. Thus, the LED modules 10 can be placed with any spacing necessary for even illumination, no matter what size or shape channels 33 are used. In FIG. 3A, single rows of modules 10 are used, while in FIG. 3B, double rows of modules 10 are used in wider channels 33 of sign 26. In FIG. 3C, the modules 10 are staggered within channel 33 to provide even illumination. FIG. 3D illustrates arrays of modules 10 to produce a more even back-lighting of the sign's front face.

Figure 4A:
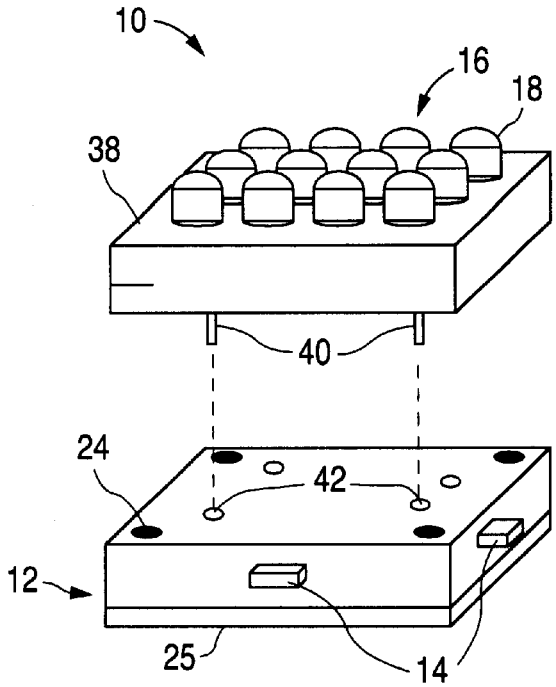
FIG. 4A is an exploded side perspective view of a first alternate embodiment of the LED module of the present invention.
Figure 4B:
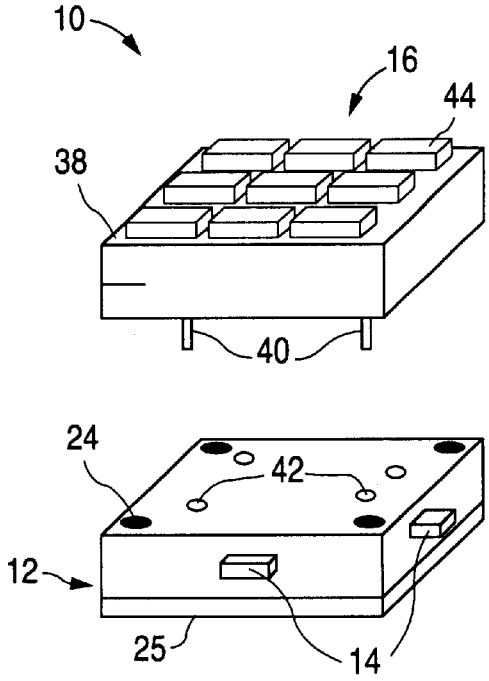
FIG. 4B is an exploded side perspective view of the first alternate embodiment of the LED module of the present invention, utilizing flat LEDs.
Figure 4C:
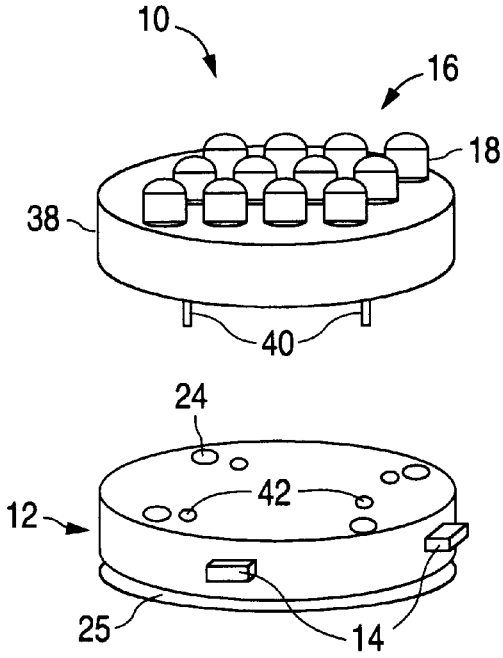
FIGS. 4C to 4D are exploded side perspective views of the different shaped housings and mounting plates for the first alternate embodiment of the LED module of the present invention.
Figure 4D:
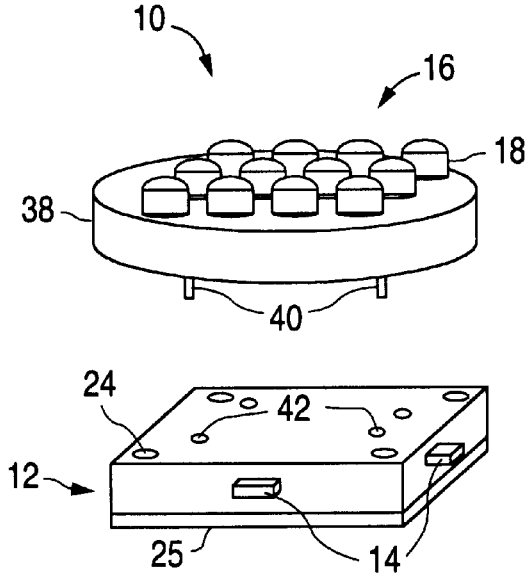

FIG. 4A illustrates an alternate embodiment of the present invention, where the LED assembly 16 includes a mounting plate 38 onto which the LEDs 18 are mounted. The mounting plate 38 can be solid or hollow, and includes pin connectors 40 extending from a bottom surface that are electrically connected to the LEDs 18. The housing includes electrical receptacles 42 on its top surface that are electrically connected to connectors 14 and are designed to receive and connect with pin connectors 40 when LED assembly 16 is mounted to housing 12. The LED assembly 16 is removably secured to the housing 12 by using a snap-on design, double stick tape, screws, and/or a friction fit between connectors 40 and receptacles 42. With this embodiment, LED assembly 16 can be conveniently attached to and removed from housing 12 without necessarily having to remove housing 12 from the sign. Thus, different LED modules 16 can be easily and repeatedly interchanged in channel sign 26. FIG. 4B illustrates the use of surface mount devices, such as Piranha or Barracuda type LEDs 44. FIG. 4C illustrates a different shaped module 10, with round shaped housing 12 and mounting plate 38. FIG. 4D illustrates a square shaped housing 12 used with a differently shaped LED assembly 16 (round mounting plate 38).

Figure 5:
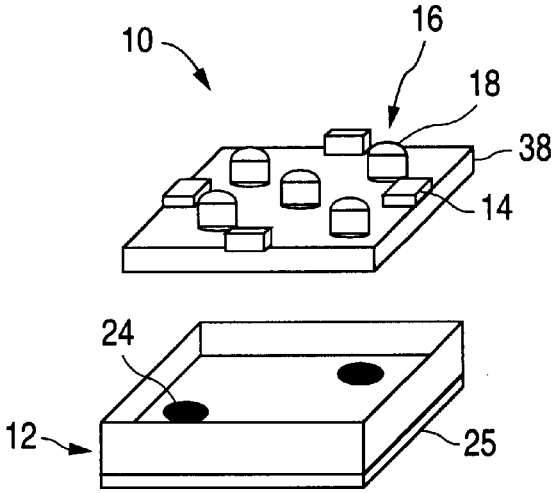
FIG. 5 is an exploded side perspective view of a second alternate embodiment of the LED module of the present invention.

FIG. 5 illustrates a second alternate embodiment of the present invention, where the electrical connectors 14 and LEDs 18 are all mounted to the mounting plate 38, which forms the top surface of the housing. With this embodiment, all the electrical devices and connectors are limited to the mounting plate 38, and are not included inside the housing 14.

Figure 6:
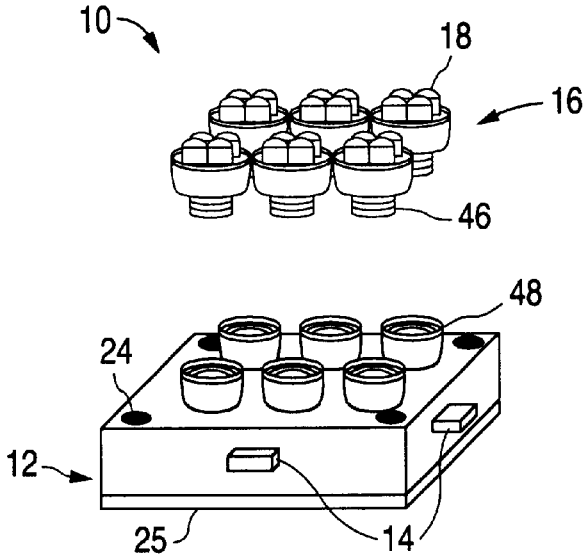
FIG. 6 is an exploded side perspective view of a third alternate embodiment of the LED module of the present invention.

FIG. 6 illustrates a third alternate embodiment, where a plurality of LEDs 18 are mounted to a threaded socket connector 46, which screws into and connects with socket receptacles 48 mounted to housing 12. Receptacles 48 are electrically connected to connectors 14. This embodiment allows the user to swap LEDs without removing housing 12 from the sign.

It is to be understood that the present invention is not limited to the embodiments described above and illustrated herein, but encompasses any and all variations falling within the scope of the appended claims. For example, while each LED module is shown with four electrical connectors 14, fewer or more can be used. A single electrical connector 14 could be used to connect with more than one pair of wires 34, thus reducing the number of connectors 14 needed on each LED module. Male/female electrical connectors can be swapped (e.g. connectors 40/42). Lastly, the present invention is not necessarily limited to channel signs, but is applicable to any sign having an illuminated translucent face.

What is claimed is:

1. A light emitting diode module for attaching to a surface of a sign, comprising:

a housing;

a plurality of light emitting diodes mounted to a top surface of the housing;

a plurality of first electrical connectors attached to side surfaces of the housing and electrically connected to the plurality of light emitting diodes;

means for attaching a bottom surface of the housing to a surface of a sign; and a power supply for providing a voltage to the light emitting diodes via at least one of the first electrical connectors.

2. The light emitting diode module of claim 1, wherein each of the plurality of light emitting diodes is mounted to direct light output away from the housing in a direction substantially perpendicular to the top surface of the housing.

3. The light emitting diode module of claim 1, wherein the means for attaching includes:

holes formed in the housing; and screws inserted through the holes and protruding through the bottom surface of the housing.

4. The light emitting diode module of claim 1, wherein the means for attaching includes an adhesive attached to the housing bottom surface.

5. The light emitting diode module of claim 4, wherein the means for attaching includes double stick tape attached to the housing bottom surface.

6. The light emitting diode module of claim 1, further comprising:

a lens disposed over the plurality of light emitting diodes to focus light output therefrom.

7. The light emitting diode module of claim 1, wherein the housing includes a top plate which forms the top surface of the housing, and wherein the plurality of first electrical connectors is attached to the top plate.

8. The light emitting diode module of claim 1, further comprising:

a plurality of second electrical connectors attached to the top surface of the housing and electrically connected to the plurality of first electrical connectors; and a plurality of third electrical connectors for releasably engaging with the second electrical connectors, wherein each of the light emitting diodes is electrically connected to one of the third electrical connectors;

wherein the plurality of light emitting diodes are releasably attached to the top surface of the housing via the second and third electrical connectors.

9. A light emitting diode module for attaching to a surface of a sign, comprising:

a mounting plate having top and bottom surfaces;

a plurality of light emitting diodes mounted to the top surface of the mounting plate;

a housing having top and bottom surfaces;

a first electrical connector attached to the bottom surface of the mounting plate and electrically connected to the plurality of light emitting diodes;

a second electrical connector attached to the top surface of the housing for engaging with the first electrical connector;

a third electrical connector attached to the housing and electrically connected to the second electrical connector; and a power supply for providing a voltage to the third electrical connector;

wherein, as the bottom surface of the mounting plate is placed on the top surface of the housing, the first electrical connector engages with the second electrical connector for electrically connecting the plurality of light emitting diodes to the third electrical connector.

10. The light emitting diode module of claim 9, wherein the each of the plurality of light emitting diodes is mounted to direct light output away from the mounting plate in a direction substantially perpendicular to the top surface of the housing.

11. The light emitting diode module of claim 9, further comprising:

means for attaching the bottom surface of the housing to a surface of a sign.

12. The light emitting diode module of claim 11, wherein the means for attaching includes:

holes formed in the housing; and screws inserted through the holes and protruding through the bottom surface of the housing.

13. The light emitting diode module of claim 11, wherein the means for attaching includes an adhesive attached to the housing bottom surface.

14. The light emitting diode module of claim 13, wherein the means for attaching includes double stick tape attached to the housing bottom surface.

15. The light emitting diode module of claim 9, further comprising:

a lens disposed over the plurality of light emitting diodes to focus light output therefrom.

16. An illuminated sign, comprising:

a back wall;

a translucent front face that opposes the back wall;

a sidewall that is attached between the back wall and the front face;

a plurality of LED modules, each LED module including:

a housing having top and bottom surfaces, a plurality of light emitting diodes mounted to the top surface of the housing, and a first electrical connector attached to the housing and electrically connected to the plurality of light emitting diodes; and a power supply for providing a voltage to the first electrical connectors;

wherein for each of the LED modules, the bottom surface of the housing is attached to the back wall so that the plurality of light emitting diodes faces the front face.

17. The illuminated sign of claim 16, wherein each of the LED modules includes a lens disposed over the plurality of light emitting diodes to focus light output therefrom.

18. The light emitting diode module of claim 16, wherein for each of the LED modules:

the housing includes a top plate which forms the top surface of the housing, and the first electrical connector is attached to the top plate.

19. The light emitting diode module of claim 16, wherein each of the LED modules includes:

a plurality of second electrical connectors attached to the top surface of the housing and electrically connected to the first electrical connector;

a plurality of third electrical connectors for releasably engaging with the second electrical connectors, wherein each of the light emitting diodes is electrically connected with one of the third electrical connectors;

wherein the plurality of light emitting diodes are releasably attached to the top surface of the housing via the second and third electrical connectors.

20. An illuminated sign, comprising:

a back wall;

a translucent front face that opposes the back wall;

a sidewall that is attached between the back wall and the front face;

a plurality of LED modules, each LED module including:

a mounting plate having top and bottom surfaces, a plurality of light emitting diodes mounted to the top surface of the mounting plate, a housing having top and bottom surfaces, a first electrical connector attached to the bottom surface of the mounting plate and electrically connected to the plurality of light emitting diodes, a second electrical connector attached to the top surface of the housing for engaging with the first electrical connector, and a third electrical connector attached to the housing and electrically connected to the second electrical connector, wherein, as the bottom surface of the mounting plate is placed on the top surface of the housing, the first electrical connector engages with the second electrical connector for electrically connecting the plurality of light emitting diodes to the third electrical connector; and a power supply for providing a voltage to the third electrical connectors;

wherein for each of the LED modules, the bottom surface of the housing is attached to the back wall so that the plurality of light emitting diodes faces the front face.

21. The light emitting diode module of claim 20, further comprising:

a lens disposed over the plurality of light emitting diodes to focus light output therefrom.

* * * * *